United States Patent [19]

Østevik

[11] 3,935,878

[45] Feb. 3, 1976

[54] ARRANGEMENT IN HEAT INPUT TO A GULLY FOR DRAINING WATER IN ORDER TO AVOID ACCUMULATION OF SNOW AND ICE

[76] Inventor: Petter P. Østevik, Storgaten 17, 6400 Molde, Norway

[22] Filed: May 14, 1974

[21] Appl. No.: 469,650

[30] Foreign Application Priority Data

May 30, 1973 Norway ..... 1753/73

[52] U.S. Cl. ..... 137/334; 52/12; 285/41

[51] Int. Cl.[2] ..... F16K 49/00

[58] Field of Search ..... 137/334, 339; 210/166, 210/185, 314; 52/12, 16; 285/41, 42

[56] References Cited

UNITED STATES PATENTS

| | | | |
|---|---|---|---|
| 824,570 | 6/1906 | Myser et al. | 52/16 |
| 1,002,611 | 9/1911 | Wagner | 52/12 |
| 1,085,886 | 2/1914 | Wagner | 52/16 |
| 2,762,448 | 9/1956 | Schmid et al. | 210/166 |

*Primary Examiner*—Henry T. Klinksiek
*Attorney, Agent, or Firm*—Brumbaugh, Graves, Donohue & Raymond

[57] ABSTRACT

An arrangement in a gully for draining water to prevent accumulation of snow and ice therein includes a substantially cup-shaped gully member, having a lower outlet socket for connection to a waste pipe and an upper circumferential support flange; and a clamping ring secured on the upper end of the gully member. A circular vertical flange on the clamping ring receives and guides an upper crown-shaped grate resting on the clamping ring and having an upper central opening. A bore through the wall of the cup-shaped member is supplied with heated air from a hot air pipe mounted in the bore in such a manner that the mouth of its free end opens into the gully member. A float valve controls the mouth of the hot air pipe, which is designed for adjustable dispersion of the airstream from the pipe mouth below the grate.

7 Claims, 2 Drawing Figures

ARRANGEMENT IN HEAT INPUT TO A GULLY FOR DRAINING WATER IN ORDER TO AVOID ACCUMULATION OF SNOW AND ICE

The present invention relates to an arrangement in heat input to a gully for draining water in ordr to avoid accumulation of snow and ice therein which may clog the gully and interfere with the drainage. The invention is especially, but not exclusively, advantageous in connection with roof-gully in order to prevent stop up thereof and resulting in damage by water.

It is previously known in connection with a roof-gully, comprising a mainly cup-shaped gully member for mounting in a roof, having a lower outlet socket for connection to a waste pipe and an upper circumferential support flange with an above applied crown-grate, to provide the gully member with a bore through which is passed a conduct pipe for an electric cable to a joint box for electric heating elements applied above the gully.

The mounting, maintenance and operating of such electrical heating means are, however, troublesome and expensive and an object of the present invention is therefore to provide an arrangement for supplying heat to a gully which is effective, reasonable in mounting and operation and wholly fire-proof, and the invention is characterized in that a pipe for supply of heated air is passed through a bore in the wall of said cup-shaped gully member with the mouth of its free end opening into said gully, means provided on said pipe for adjustable dispersion of the airstream from said pipe mount below said grate and a float valve controlling said mouth.

Figure 1:
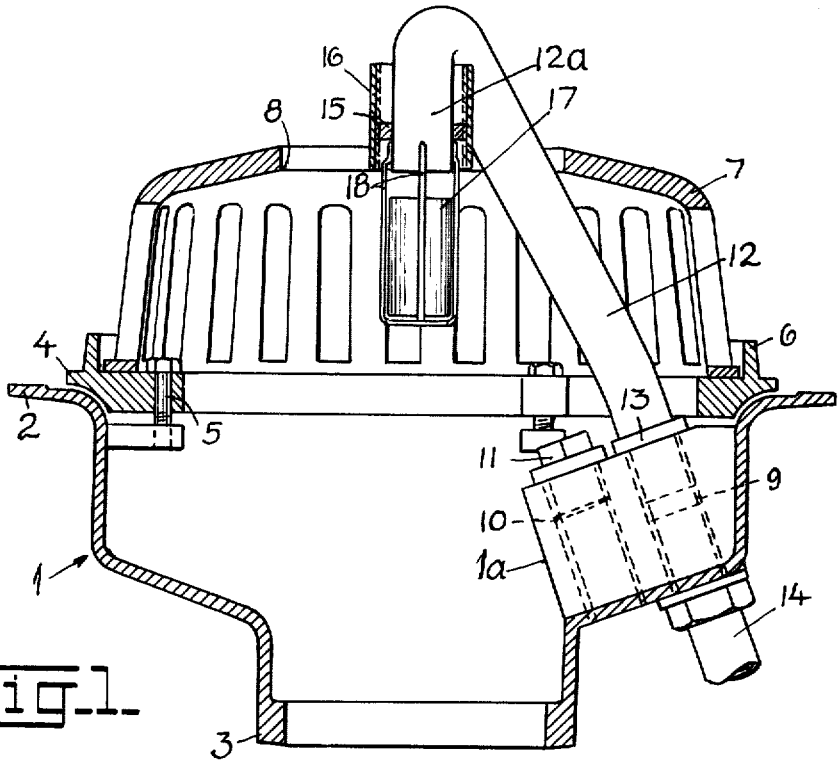
Figure 2:
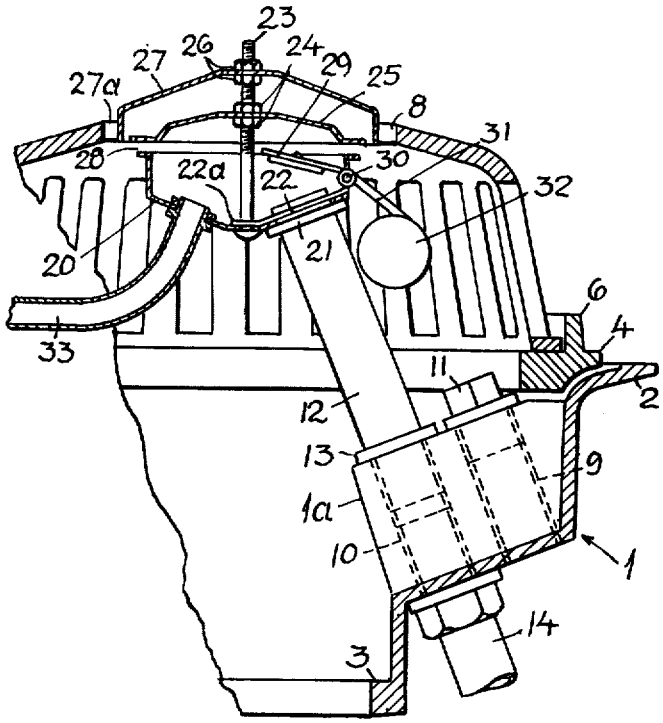

An embodiment of the invention is illustrated as example in the accompanying drawing in which:

FIG. 1 is an axial cross-section through a roof-gully according to the present invention, and FIG. 2 shows a part of a similar view of a somewhat modified embodiment.

In the drawing FIG. 1 shows a roof-gully comprising a mainly cup-shaped member 1 forming the passage through a roof and having an upper circumferential support flange 2 and a lower outlet socket 3 for connection to a drain pipe (not shown). A clamping ring 4 is secured to the upper end of the member 1 by means of screws 5 and has a vertical circular flange to receive and guide an upper crown-shaped grate 7 having a central upper opening 8.

The gully member 1 is inside provided with a radial rib-shaped thickening 1a having two parallel through-going preferably threaded bores 9 and 10 respectively, of which in the embodiment shown, bore 10 is closed by means of a screw plug 11.

To the inner end of the bore 9 is connected a blow pipe 12 by means of a threaded lower end which is screwn into said bore a length limited by a flange 13 on the pipe. The blow pipe 12 extends from the rib 1*a* in an upwardly inclined direction through the opening 8 of the grate 7 and has its free end portion 12*a* bent down so that the axis thereof substantially coincides with the axis of the gully with the mouth directed downwards. The end portion 12*a* of the pipe 12 is provided with an externally threaded flange 15 on which an adjustable regulating sleeve 16 is screwably mounted.

Heated air which is supplied to the gully through a pipe 14 connected to the outer end of the bore 9 flows through the pipe 12, 12*a* and is distributed by dispersion within the gully in such a manner that accumulation of snow and ice is effectively prevented. In using heated air as heating means the removal of snow may also take place by evaporation whereby formation of water is decreased.

By axial adjustment of the sleeve 16 the dispersion of the air stream from the pipe portion 12*a* may be regulated.

If of some reason the gully should stop up, possibly acccumulated water is prevented from streaming into the pipe 12 by means of a float valve 17 which then closes the lower open end of the pipe portion portion 12*a*. Said float valve comprises a preferably cylindrical float body 17 placed vertically movable in a basket like guiding or holder 18 of wires secured on the pipe portion 12*a*, as shown. In order to ase the escape of the heated air and at the same time increase the closing effect of the float member the upper end thereof may be formed as an truncated cone having an upper surface of somewhat smaller diameter than that of the bore of the pipe portion 12*a*.

As heating air for the gully it is possible to use air ejecting from an accessible air-conditioning or hot air heating plant to the outlet of which he supply pipe 14 may be connected, and in this case the working expenses will be small, or from a separate heating chamber for pressurized air.

FIG. 2 shows a somewhat altered embodiment of the invention in which parts similar to those in FIG. 1 are indicated by similar reference numerals.

In this embodiment the blow pipe 12 is secured in the bore 10 while the bore 9 is closed by the screw plug 11. The pipe 12, extending upwards and inwards in direction towards thee centre of the opening 8 of the grate 7, has its end led through the bottom wall of a centrally in the grate 7 positioned cup-shaped, upwardly open container 20, secured on the pipe between flanges 21 and 22 thereon. Through the bottom of the container 20 and a tongue 22*a* projecting from the flange 22 is secured the lower end of a vertical screw 23, the axis of which coincides with the axis of the gully, and on which between securing nuts 24 is adjustably secured a downwardly arched cover 25 for cooperation with the container 20. Above the cover 25 is further on the screw 23 adjustably secured, also between nuts 26, a cup-shaped container 27 having a downwardly directed cylindrical flange 27*a*.

The container 20 and cover 25 are each provided with an outer ringshaped circumferential flange, which flanges thus limit an adjustable circular slit 28 through which air from the pipe 12 flows into the gully. In order to regulate the direction and dispersion of the air streaming out through the slit 28 the container 27 may be adjusted vertically on the screw 23 to screen by means of the cylindrical flange 27*a* thereof, the slit 28 to a greater or smaller degree.

In this embodiment the float valve to prevent that possible accumulated water escapes through pipe 12 comprises a flap valve 29 swingably supported on a pivot 30 on the flange 22 and connected to a lever 31 provided with a floating body 32, which in case of accumulation of water in the gully, in known manner is lifted and swings the valve 29 into closing position against the end of the pipe 12, prior to the water level reach the upper end of said pipe 12.

If desired one or more branch pipes 33 may be connected to the container 20 through which heated air from the container may be reforwarded for exhausting upon the roof, for supplying a further gully or to another desired place.

I claim:

1. Arrangement in a gully for draining water in order to avoid accumulation of snow and ice therein, comprising a mainly cup-shaped gully member, having lower outlet socket for connection to a waste pipe and an upper circumferential support flange, a clamping ring secured on the upper end of said member, a circular vertical flange on said clamping ring to receive and guide an upper crown-shaped grate resting on said clamping ring and having an upper central opening, a bore through the wall of said cup-shaped member, a pipe for supply of heated air mounted in said bore with the mouth of its free end opening into said gully, means provided on said pipe for adjustable dispersion of the airstream from said pipe mouth below said grate and a float valve controlling said mouth.

2. Arrangement according to claim 1, in which a free end portion of the upwardly directed air supplying pipe is bent downwards substantially coinciding with the axis of said gully and provided with an external threaded flange on which a regulating sleeve is arranged axially screwable.

3. Arrangement according to claim 2, in which the downwardly bent end of the supply pipe is provided with an axial wire basket adapted to contain a float body for closing of the open end of the pipe.

4. Arrangement according to claim 1, in which the end of the upwardly directed air supplying pipe opens into a cup-shaped inwardly open container secured on said pipe, a cover supported vertical adjustably above said container for regulation of a slit shaped exhaust opening between said container and cover.

5. Arrangement according to claim 4, in which a flap valve is pivotally supported at the end of the supply pipe and provided with a projecting lever carrying a float body.

6. Arrangement according to claim 4 in which a cup-shaped container having a downwardly directed cylindrical flange, is supported vertically adjustable above the container and cover forming said slitshaped exhaust opening so that the air ejecting from said opening may be regulated by means of said cylindrical flange.

7. Arrangement according to claim 4, in which at least one branch pipe is connected to the cup-shaped container secured on the end at the supply pipe, for reforwarding heated air from said container.

* * * * *

UNITED STATES PATENT AND TRADEMARK OFFICE

CERTIFICATE OF CORRECTION

PATENT NO. : 3,935,878

DATED : February 3, 1976

INVENTOR(S) : Petter P. Ostevik

It is certified that error appears in the above-identified patent and that said Letters Patent are hereby corrected as shown below:

Col. 1, line 7, "ordr" should read --order--;
Col. 2, line 10, "acccumulated" should read --accumulated--;
Col. 2, line 12, delete "portion" (second occurrence);
Col. 2, line 16, "ase" should read --ease--;
Col. 2, line 24, "he" should read --the--;
Col. 2, line 34, "thee" should read --the--; and
Col. 4, line 7, "inwardly" should read --upwardly--.

Signed and Sealed this

*first* Day of *June 1976*

[SEAL]

*Attest:*

RUTH C. MASON
*Attesting Officer*

C. MARSHALL DANN
*Commissioner of Patents and Trademarks*